United States Patent [19]

Horton, Jr. et al.

[11] 3,974,764

[45] Aug. 17, 1976

[54] EXHAUST VALVE

[76] Inventors: Edward L. Horton, Jr.; Anna M. Horton, both of 4706 Highview Blvd., Erie, Pa. 16509

[22] Filed: Apr. 12, 1974

[21] Appl. No.: 460,359

[52] U.S. Cl. ..... 100/269 R; 91/6; 91/441

[51] Int. Cl.[2] ..... B30B 1/34; B30B 15/18; F15B 13/042

[58] Field of Search ..... 91/31, 6, 28, 441, 420; 100/269; 137/605

[56] References Cited

UNITED STATES PATENTS

| | | | |
|---|---|---|---|
| 1,940,668 | 12/1933 | Ernst | 91/28 X |
| 2,077,894 | 4/1937 | Patrick | 91/441 X |
| 2,161,804 | 6/1939 | Dinzl | 91/6 X |
| 2,210,284 | 8/1940 | Dinzl | 91/441 X |
| 2,526,800 | 10/1950 | Brehm et al. | 91/441 X |
| 2,922,397 | 1/1960 | Haanes | 91/26 |
| 2,973,744 | 3/1961 | Hennells | 91/26 |
| 3,068,841 | 12/1962 | Robbins | 91/441 X |
| 3,888,168 | 6/1975 | Kent et al. | 100/269 R |

*Primary Examiner*—Irwin C. Cohen

[57] ABSTRACT

A valve for rapidly filling and emptying a volume created by rapid displacement of a machine member. The valve has a body to be connected between a reservoir and the machine. The valve has a valve seat with a seating surface that surrounds the flow path of fluid from the volume and an integral valve guide connected to the seat. A valve opening toward the machine is spring urged toward closed position to withstand high pressure of the fluid at the machine. An auxiliary mechanism is provided to open the valve which may be a solenoid, a pilot piston, or fluid cylinder or manual operation. The valve is provided with a dashpot to provide smooth operation.

8 Claims, 6 Drawing Figures

EXHAUST VALVE

BACKGROUND OF INVENTION

The valve disclosed herein is known as a freefill and exhaust valve designed to afford fast approach and return speeds of main rams of high speed presses and similar machines. The valve may be used for any or all of the basic functions of large volume hydraulic presses at low pressure to allow fluid to flow into the ram cylinder while the ram is being advanced or returned by gravity, or by some other means. The valve can also be used to dissipate the pressure energy in the press at a controlled rate and to rapidly exhaust hydraulic fluid in the ram cylinder back to the tank after decompression. The press ram creates a vacuum as the ram moves downward on its approach stroke causing the valve to open due to pressure differential and permit hydraulic fluid to flow from the reservoir into the main cylinder. When the pressure in the main cylinder builds up, the pressure in the cylinder or removal of pilot pressure cause the valve to close. To open the valve, in order for the hydraulic fluid to be exhausted from the main cylinder and return to the tank, an auxiliary force is provided. A pilot supply of hydraulic fluid from the main return line passes through a connecting block in the valve assembly and acts upon a valve operating piston to decompress and open the main valve after decompression. This permits hydraulic fluid to exhaust from the main ram cylinder to the tank. The spring pressure holds the main valve closed upon its seat when it is not otherwise actuated. The valve illustrated could be used with any suitable liquid or gas.

OBJECTS OF THE INVENTION

It is an object of the invention to provide an internal seat and valve stem guide in a valve with extended guide bushings supported by the bottom spring retainer.

Another object of the invention is to provide a cushion control for the pilot operating piston on which the valve is opened and closed. The valve opening and closing being adjustable to a predetermined rate, avoiding shock and other undesirable conditions of operation.

Another object of the invention is to provide an automatically operated decompression valve which allows smooth shockless opening of the valve when under high pressure conditions on the seat side of the valve. This allows small operating piston to open a relatively large valve against high pressure.

Another object of the invention is to provide a method of allowing a high volume, low or high pressure source of fluid to enter the system directly through the valve thereby eliminating the necessity of auxiliary connection in the operating cylinder.

Another object of the invention is to provide a hydraulic operated pilot valve and pilot cylinder head and sidewall having a flow passage.

Another object of the invention is to provide a valve with means to eliminate shock in operation.

With the above and other objects in view, the present invention consists of the combination and arrangement of parts hereinafter more fully described, illustrated in the accompanying drawings and more particularly pointed out in the appended claims, it being understood that changes may be made in the form, size, proportions, and minor details of construction without departing from the spirit or sacrificing any of the advantages of the invention.

GENERAL DESCRIPTION OF THE DRAWINGS

DETAILED DESCRIPTION OF THE DRAWINGS

Figure 1:
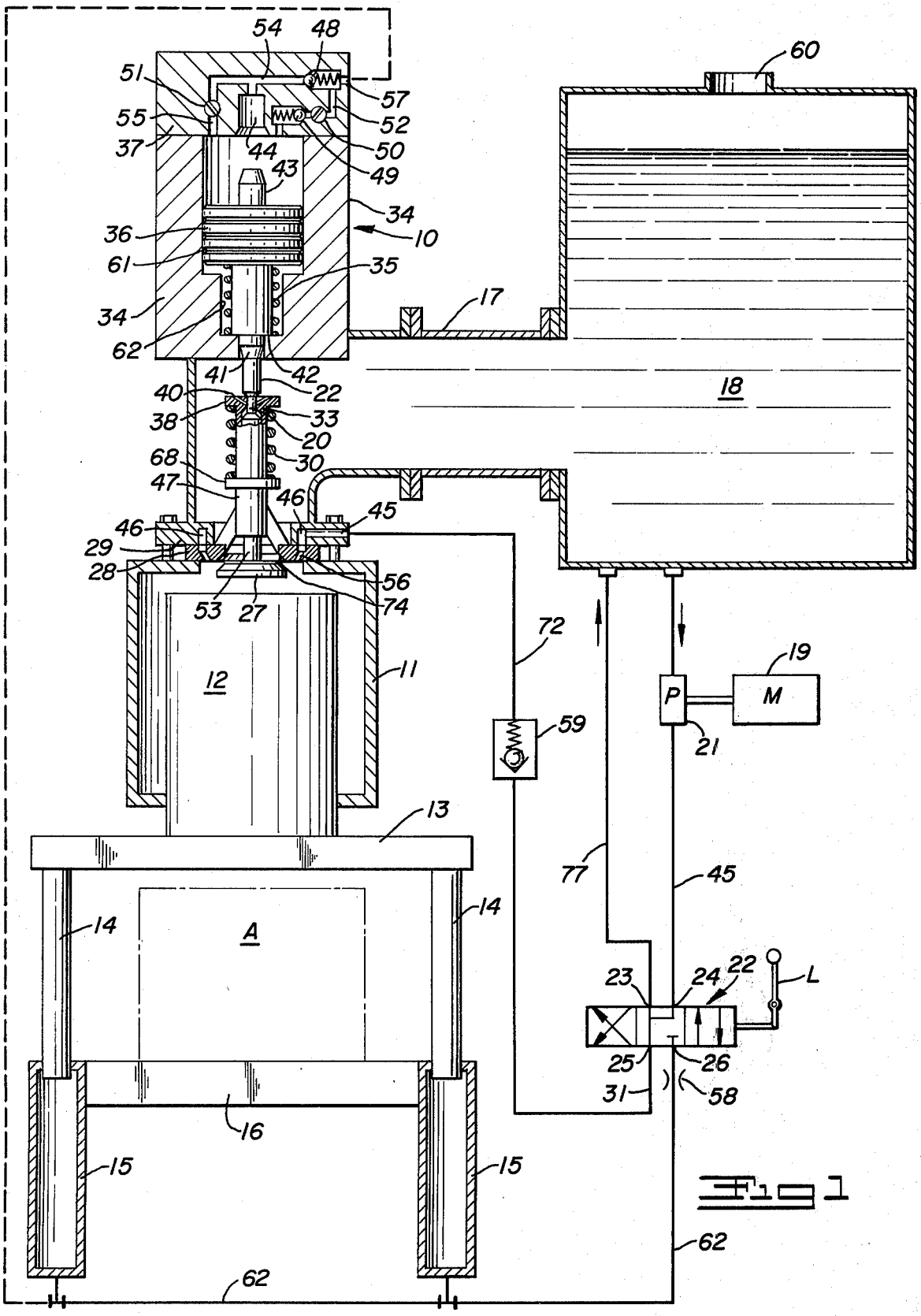
FIG. 1 is a schematic diagram of a valve in a hydraulic circuit according to the invention.

Now with more particular reference to the drawings, the valve shown is for rapidly filling and emptying a reservoir, for example, the reservoir 18. The reservoir 18 is shown connected through the freefill exhaust valve 10 to the user's main cylinder 11 on the machine of the user.

The machine has a piston ram 12 supported in main cylinder 11. The ram piston 12 is connected to the crosshead 13 which is in turn connected to the pushback rams 14. Two pushback rams 14 are shown, however, a machine may have any number of such rams, for example, one ram or more. The main ram may be double acting with piston rings or packings on its piston portion thereby negating the necessity for any auxiliary pushback rams. The pushback rams 14 are supported on the fixed frame of the machine and slidably supported in the pushback cylinders 15. The pushback cylinders 15 are connected to the pushback line through the fixed orifice 58. The fixed orifice 58 in the pushback line 62 controls the maximum speed of descent of the ram 12.

The press shown has a bottom crosshead or platen 16 which supports the work indicated at A.

The valve 10 is connected to the reservoir by a connecting section 17 which connects the working fluid to the user's main cylinder 11. The valve 10 could be mounted in reservoir 18. The fluid in reservoir 18 is generally at zero gage pressure and the fill opening 60 may be provided at the top of the reservoir for refilling the reservoir as required.

The pump 21 may be driven by the motor 19. The pump 21 is connected to the machine by the operating valve 22 to connect fluid from pump 21 to pushback cylinders 15. The connection 23 of operating valve 22 is connected to the reservoir 18 through line 77 and line 45 connects the pump 21 to connection 24. The main cylinder 11 is connected to connection 25, by way of check valve 59 and pushback cylinders 15 are connected to the valve 22 by lines 26 and 62 through fixed orifice 58. A plurality of orifices 57 in valve 28 admit fluid to cylinder 11 from line 72. Line 31 connects valve 22 to valve 59. The freefill and exhaust valve 10 are generally made up of the main valve member 27, which cooperates with the integral valve seat 28. Seat 28 surrounds the flow passage from the valve body to the cylinder 11. The valve is fixed by connecting flange 29 to the cylinder 11. The valve member 27 is urged to closed position by the main valve spring 30. The pilot piston spring 35 may not be necessary if the valve spring 31 is strong enough to close the pilot valve 32. Decompression valve spring 31 is disposed in the decompression valve housing which has a flange 38 internally threaded to connect to the male threads on the upper end of the valve stem of main valve 27. The decompression valve body retainer 33 which has an internal seat 73 on it and the decompression valve 20 is urged to closed position by the spring 31 which is supported in the hollow of decompression valve housing 32. The pilot cylinder 34 is integrally attached to the valve body 10. Pilot piston 36 has peripheral pressure equalization grooves 57. The pilot cylinder head 37 closes the upper end of the cylinder 34.

The hollow 39 extends through the valve stem 53 and connects fluid from reservoir 18 to cylinder 11 when valve 20 is open. The orifice 40 allows the escape of fluid under pressure from the cylinder when decompression valve 20 opens. The lower tapered flange 41 on the cushion stem of the pilot piston 36 cushions the downward movement of the piston 36 at the end of its downward stroke. The seating surface 42 cooperates with flange 41 and forms a check valve to prevent escape of pilot fluid through hole 41' when the pilot piston 36 is at the bottom of its stroke. The upper tapered cushion stem 43 of the pilot piston 36 cushions the piston 36 on its upward stroke and cushions main valve 27 following piston during return stroke of the pilot piston 36 at the closing of valve 27 and thus prevents slamming of valve 27. The cushion pocket 44 in the head 37 freely accepts the stem 43 of pilot piston 36. The connecting orifice 58 connects fluid from the pump 21 to the cylinder 11 to accomplish work at the bottom of the stroke and high pressure. The flow passage 46 in the valve mounting flange 29 is connected to distribute oil from pump 21 around the orifices formed by passage 46 so that pump 21 delivery can be made into the cylinder 11 without restriction. The several orifices 56' are sufficiently large and numerous to prevent restriction of pump oil from flowing into the cylinder 11, thereby allowing free flow thereinto.

The check valve 48 prevents pilot fluid from entering the pilot cylinder 34 directly and from forcing the pilot fluid to pass through variable restriction 50 so that the speed at which pilot piston 36 moves may be controlled, thereby controlling the decompression rate through valve 32 and also controlling the opening speed of the main valve 27.

The check valve 49 prevents the escape of pilot fluid directly from the pilot cylinder 34 after cushion stem 43 enters pocket 44, forcing the pilot fluid to go through the variable orifice 51, controlling the closing speed of valve 32 and main valve 27. The variable orifice 51 controls the upward movement of the pilot piston 36. The orifice 50 controls the downward speed of piston 36 and the dashpot effect of flange 41 acts as a stop on the bottom end of the stem of piston 36 and valve 27 when opening. Passage 54, passage 55 and passage 52 provide for additional cushioning and may not be necessary when used in connection with the variable restriction 51 to control cushioning of valve 27.

Fluid displacement builds up pressure of oil between the seating surfaces of valve 27 of the valve seat 28, preventing slamming together of the surfaces. Pump flow may add oil and further control the seating action although this may not be required except in cases of severe pressure differential. The pilot pressure connection port 57 is formed in the cylinder head 37. The fixed orifice 58 is in the pushback line to control the maximum speed descent of the ram 12. Check valve 59 in the pressure line 72 from pump 21 prevents the rapid shocking decompression of the cylinder 11 through the valve 22 when the manual lever on the valve 22 is suddenly moved to return position of the valve 22.

Neutral

With the manual control lever L of the valve 22 in neutral position as shown, the ram 12 in the up or return position is held there by the pushback ram 14 which is supported by fluid pressure in cylinders 15. Pressure is contained by the blocking port 26 of the valve 22 and generated by the weight of the ram 12 on crosshead 13. The same pressure is available at the port 57 of the pilot head 37, holding the pilot piston 36 down against its spring 35 against decompression valve 32. This pressure will also hold valve 27 open if the pressure is sufficient to overcome spring 30. Pump fluid discharge (motor 19 running) is recirculated through the port 24 to the port 23 of the valve 22 and thence back to the reservoir 18. When the operator moves the handle L of the manual valve 22 to the "down" position of the valve 22, so that fluid can escape from cylinder 11, the ram 12 will then descend.

Close

Figures 2, 2A, 3:
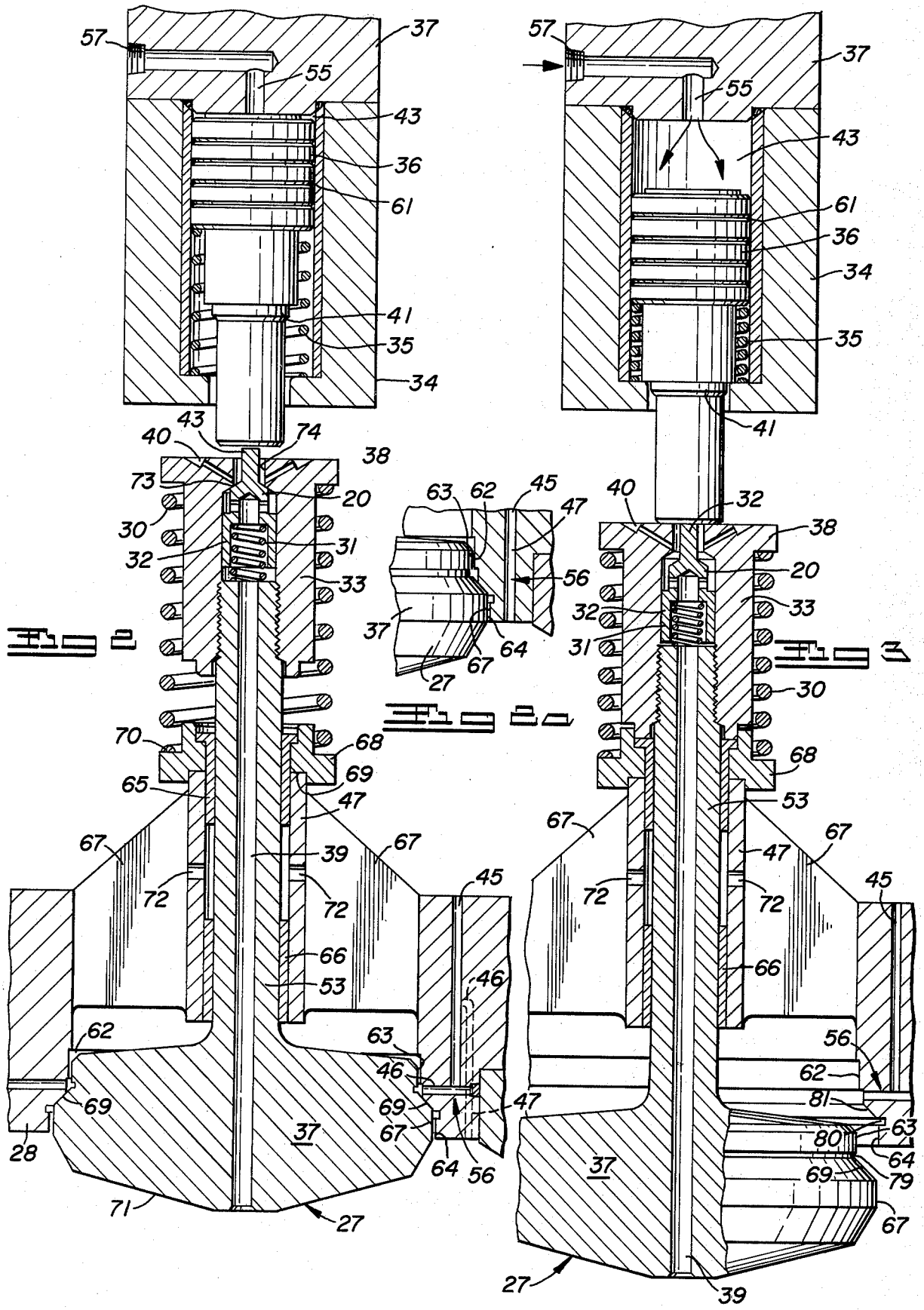
FIG. 2 is an enlarged cross sectional view of the valve shown in FIG. 1 showing the valve closed.
FIG. 2A is an enlarged view showing a cross sectional view of the valve taken through one of the bypass passages.
FIG. 3 is an enlarged partial view showing the valve in open position.

When the valve 22 is moved to the close position the port 24 is connected to port 25 and thence to port 45', allowing fluid to flow to the cylinder 11. The block port 26 is open to port 23 of the valve 22, allowing fluid in cylinders 15 to exhaust to the reservoir 18. Back pressure in pilot line 62 to port 57 of the valve 10 created by the rush of fluid through the orifice 58 continues to hold the valve 27 open. Fluid from reservoir 18 flows freely into the cylinder 11 as ram 12 moves rapidly downward in cylinder 11. As ram 12 and crosshead 13 move down, its speed may be controlled by the operator by adjusting the position of the manual control on control valve 22. A throttling action results thereby controlling the rate of exhaust of the cylinders 15. When the crosshead 13 contacts the work, the speed of the crosshead 13 and ram 12 is decreased greatly and pressure of fluid in the pilot pressure line 62 is reduced due to the small flow condition, then piston 36 moves out of the way. Decompression valve 20 is closed by spring 31 when piston 36 is in the position shown in FIG. 2. The spring 30 of valve 10 closes valve member 27 pushing piston 36 upward rapidly until the tapered cushion seat stem 43 enters the pocket 44, restricting the flow to the variable orifice 51 which controls the closing rate of the valve 27. The pilot piston 36 continues to move up at a controlled speed and finally its spring 35 pushes its stem away from the decompression valve 32, allowing the decompression valve 32 to close valve member 27 which finishes its closing action with additional cushioning action by virtue of the holes 56. The head 37 cushioning holes 56 may either be used separately; both at one time would probably be unnecessary in most applications. The pump discharge continues to flow through valve 22 from the port 24 to port 25 of the valve 22 and thence to cylinder 11 through the port 46' and orifices 56'. A high pressure builds up in the cylinder 11 and the final work by ram 12 is accomplished.

Return Stroke of Piston 12

When the work is accomplished and the operator desires to open the press by raising ram 12, he moves the manual lever of the valve 22 to the up position. The pump fluid is then diverted to the port of the valve 22 connected to line 26 and then to the pushback line 62. The pilot pressure rushes into the pilot passages 55 and 57 of the pilot head 37 but is controlled by the variable orifice 50 so that pilot piston 36 moves down at a controlled speed contacting decompression valve 32 and opening it thus allowing fluid to leave cylinder 11 and decompress it through valve 27 back to the reservoir 18. When the pressure in cylinder 11 is dissipated, the piston 36 continues to move down against its spring 35. The final rate of opening is controlled or cushioned by fluid flowing through orifice 40. The rate of descent of pilot piston 36 is adjusted by adjusting variable restriction 50, so that all this operation takes place quietly without any destructive shock.

With valve 27 closed so that no leakage can take place from the pilot cylinder 34, the return speed of the pushback rams 14 due to fluid loss through the reservoir is reduced. With valve 27 open, fluid flows freely from cylinder 11 to reservoir 18. The pump continues to supply fluid through the ports 24 and 26 of valve 22 connected to lines 45'' to cylinders 15 raising the crosshead 13 and ram 12 until the operator moves valve 22 to neutral positions.

The valve 10 includes the seat guide member 28 and main valve member 27. The annular valve seat 81 is integral with the stem guide 64. Lube holes 72 are formed in the stem guide 64. A collar 68 has a counterbore which receives the upper end of the stem guide 64. The lower end of the compression spring 30 rests on the shoulder 70 on the collar 68. The upper end of the spring 30 rests against the flange 38 on the decompression valve housing 33. The decompression valve housing 33 is threadably attached to the stem 53 of the valve 27. The valve 27 has the head 71 and integral stem 53. The spring 30 urges the decompression housing and valve 27 upwardly so that the valve seating surface of the valve 27 is brought into engagement with the valve seat 69.

Decompression valve 32 has a hollow cylindrical part that receives the spring 31. Spring 31 rests on the upper end of the stem 43 urging the decompression valve 32 to closed position. The valve member has a laterally extending opening which communicates with the outside thereof so that when the decompression valve is in the position shown in FIG. 3, fluid can pass through the hollow 39 in the stem 53 and out around the decompression valve 32 into the reservoir. When the piston 36 moves to the position shown in FIG. 2, the pressure will be relieved from the end of the decompression valve 32 and from the end of the decompression housing, thus the spring 31 will close the decompression valve and the spring 30 will push the valve member 27 to closed position.

The valve head 71 has the outer peripheral cylindrical surfaces 67 and 63 which fit closely into internal cylindrical surfaces 64 and 62 respectively. At the time the valve 27 moves toward partly closed position and valve head 71 enters the cylindrical surfaces 64 and 62 of the valve head, fluid is trapped in the space enclosed between the valve head 71 and the two cylindrical surfaces 67 and 63 on the valve head 71 and the cylindrical surfaces 64 and 62 on the valve seat. This trapped fluid is forced out through passages 56 and 45 back into the reservoir 18. Passages 45 and 56 may be equipped with a suitable flow control device such as a fixed orifice, a throttling valve, or any suitable flow control means which may be actuated by a suitable actuating device to control the rate of flow.

Thus, the space enclosed by the surfaces 67 and 62 on the outer periphery of valve head 71 cooperates with the internal cylindrical surfaces 64 and 63 and acts as a dashpot limiting the closing rate of valve 27 to a rate determined by the escape of fluid from passages 45 and 56.

Figure 4:
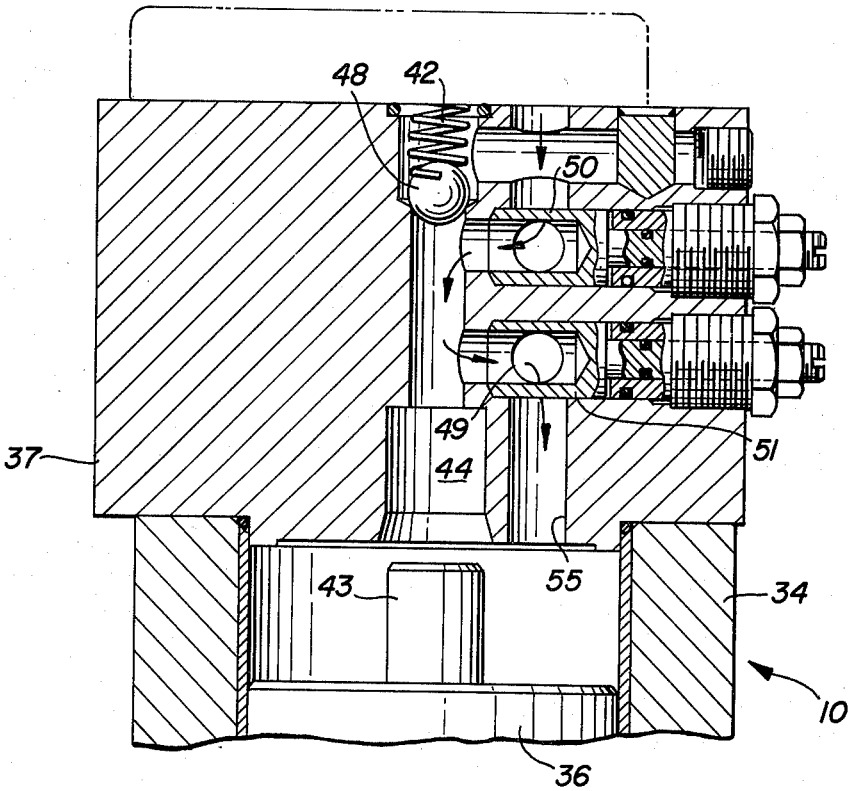
FIG. 4 is an enlarged cross sectional view of the throttling ports for controlling the actuating fluid of the valve.
Figure 5:
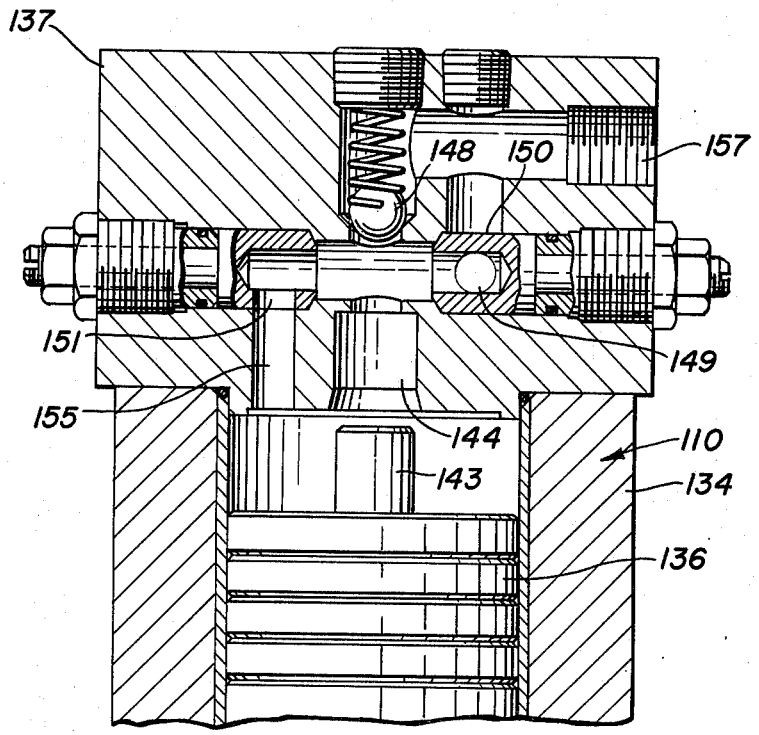
FIG. 5 is a cross sectional view similar to FIG. 4 of another embodiment of the invention.

FIG. 5 shows a view similar to FIG. 4 showing the orifices in a different orientation with 100 added to the index numerals of corresponding parts.

The foregoing specification sets forth the invention in its preferred practical forms, but the structure shown is capable of modification within a range of equivalents without departing from the invention which is to be understood is broadly novel as is commensurate with the appended claims.

The embodiments of the invention in which an exclusive property or privilege is claimed are defined as follows:

1. In combination a machine having a ram cylinder, a ram piston in said cylinder extending downwardly therefrom and engaging a crosshead, a platen supported below said ram piston for supporting work to be engaged by said crosshead, a reservoir adapted to contain liquid supported above said ram cylinder and having a passage in a wall thereof, means connecting said reservoir to said ram cylinder, said means connecting said reservoir to said ram cylinder comprising a flow passage, a separate valve seat supported on said ram cylinder around said flow passage positioned between the top of said ram cylinder and said reservoir and a freefill and exhaust valve adapted to engage said valve seat to stop the flow of fluid from said reservoir to said ram cyliner to provide fast approach speeds and fast return speeds of said ram whereby fluid from said reservoir can flow to said ram cylinder at low pressure when said freefill valve is open, pilot motor means connected to said free fill and exhaust valve for opening said free fill and exhaust valve, a plurality of circumferentially spaced orifice means in said valve seat opening directly into said ram cylinder and pump means connecting said reservoir to said cylinder through said reservoir passage and said spaced orifice means to said ram cylinder, and check valve means connected to said orifice means for allowing fluid to flow from said pump through said orifice means in said seat forming a path for the flow of fluid from said orifice means through said pump at high pressure, and pushback pistons supporting said platen pushback cylinders supporting said crosshead and receiving said pushback pistons and means selectively connecting fluid from said reservoir to said pushback cylinders and to said pilot motor means controlling said freefill valve and to said orifice means.

2. The combination recited in claim 1 wherein said pilot motor means urging said freefill valve to open position comprises a pilot cylinder, a pilot piston in said pilot cylinder, said pilot piston having means thereon to engage said freefill valve for moving said freefill valve to open position, when said pilot piston is moved toward said freefill valve.

3. The combination recited in claim 2 wherein said pilot cylinder has a return spring thereon engaging said pilot piston, urging said pilot piston away from engagement with said freefill valve.

4. The combination recited in claim 3 wherein said freefill valve and said pilot cylinder each have a separate dashpot means connected thereto for limiting the closing rate of said freefill valve and said pilot piston.

5. The combination recited in claim 4 wherein guide means are associated with said ram cylinder, said freefill valve member has a hollow stem and said hollow stem extends from guide means on the ram cylinder to support a guide means, a spring fixed to the distal end of said valve stem, and said spring on said valve stem engaging said valve stem guide means and said spring urging said freefill valve to closed position.

6. The combination recited in claim 5 wherein said freefill valve member has a hole in the center thereof, said hole in said center of said freefill valve member connected through said hollow in said stem to said reservoir.

7. The combination recited in claim 5 wherein said means connecting said pilot cylinder with said push-back cylinders includes a first check valve and, an adjustable orifice means for limiting the flow of liquid from said pilot cylinder to said reservoir.

8. The combination recited in claim 7 wherein a second check valve is provided in parallel with said first check valve, and an adjustable orifice in series with said second check valve whereby liquid from said reservoir to said pilot cylinder is limited.

* * * * *